US007432919B2

(12) United States Patent
Inoue et al.

(10) Patent No.: US 7,432,919 B2
(45) Date of Patent: Oct. 7, 2008

(54) DISPLAY DEVICE

(75) Inventors: Masutaka Inoue, Osaka (JP); Atsuhiro Yamashita, Osaka (JP)

(73) Assignee: Sanyo Electric Co., Ltd., Osaka (JP)

( * ) Notice: Subject to any disclaimer, the term of this patent is extended or adjusted under 35 U.S.C. 154(b) by 719 days.

(21) Appl. No.: 10/952,441

(22) Filed: Sep. 29, 2004

(65) Prior Publication Data

US 2005/0110786 A1 May 26, 2005

(30) Foreign Application Priority Data

Sep. 29, 2003 (JP) ..... 2003-338897

(51) Int. Cl.
*G09G 5/00* (2006.01)
*G09G 3/30* (2006.01)

(52) U.S. Cl. ..... 345/204; 345/76

(58) Field of Classification Search ..... 345/36, 345/48, 76, 77, 84, 87–100, 204
See application file for complete search history.

(56) References Cited

U.S. PATENT DOCUMENTS 6,710,548 B2 * 3/2004 Kimura ..... 315/169.3
6,911,781 B2 * 6/2005 Yamazaki et al. ..... 315/169.3
7,088,052 B2 * 8/2006 Kimura ..... 315/169.2
7,218,297 B2 * 5/2007 Inukai et al. ..... 345/82

FOREIGN PATENT DOCUMENTS

JP 10-312173 11/1998
JP 2002-311898 A 10/2002

* cited by examiner

*Primary Examiner*—Jimmy H Nguyen
*Assistant Examiner*—Jean E. Lesperance
(74) *Attorney, Agent, or Firm*—McDermott Will & Emery LLP

(57) ABSTRACT

The present invention provides a display device comprising a display having an arrangement of a plurality of pixels, a drive IC for supplying to each pixel of the display data voltage or data current corresponding to a video signal fed from the outside, comparing/calculating unit for supplying the video signal to the drive IC, and a current monitor unit for measuring the total quantity of currents to have been passed through a plurality of pixels of the display. The comparing/calculating unit derives the sum of currents to be passed through each pixel of the display based on the values of the video signals for each pixel of the display, to correct the video signals for each pixel of the display based on the derived value and measurement value obtained by the current monitor unit.

16 Claims, 13 Drawing Sheets

DISPLAY DEVICE

BACKGROUND OF THE INVENTION

1. Field of the Invention

The present invention relates to display devices, such as organic electroluminescence display devices, which include a display panel comprising an arrangement of a plurality of pixels.

2. Description of Related Art

Progress has been made in developing organic electroluminescence displays (hereinafter referred to as "organic LED displays") in recent years. Use of organic LED displays, for example, in portable telephones is under study.

The methods of driving such organic LED displays include the passive matrix driving method wherein the scanning electrodes and the data electrodes are used for time division driving, and the active matrix driving method wherein each pixel is held luminescent for one vertical scanning period. Furthermore, the methods of driving the organic LED display devices of the active matrix driving method include the display devices of the analog drive type wherein current of a magnitude corresponding to the data voltage is supplied to an organic EL element to turn on the EL element with a brightness corresponding to the data voltage, and the display devices of the digital drive type in which a multi-level gradation is produced by supplying to an organic EL element a pulse current having a duty ratio in accordance with the data voltage (e.g., JP-A No.312173/1998).

The present applicants have proposed the organic LED display devices of the digital drive type having a display panel comprising an arrangement of pixels 31 having a circuit structure shown in FIG. 15. With the organic LED display devices, each pixel 31 is provided with an organic EL element 30, a drive transistor TR2 for effecting or interrupting passage of current through the organic EL element 30 in response to input of an on/off control signal to a gate, a write transistor TR1 which is brought into conduction in response to the application of scanning voltage by a scanning driver, a capacitance element C to be supplied with a data voltage from the data driver by the write transistor TR1 conducting, and a comparator 32 having a pair of positive and negative input terminals to be supplied with the ramp voltage from the ramp voltage generating circuit and the output voltage of the capacitance element C for comparing the two voltages. The output signal of the comparator 32 is fed to the gate of the drive transistor TR2. The drive transistor TR2 has a source connected to a current supply line 33 and a drain connected to the EL element 30. The data driver is connected to one electrode (e.g., source) of the write transistor TR1. The other electrode (e.g., drain) of the write transistor TR1 has connected thereto one end of the capacitance element C and an inversion input terminal of the comparator 32. The output terminal of the ramp voltage generating circuit 8 is connected to a non-inversion input terminal of the comparator 32.

With the organic LED display device, one field period is divided into a first half scanning period and a second half luminescence period as shown in FIG. 16(*a*). During the scanning period, the scanning driver applies a scanning voltage to the write transistor TR1 constituting each pixel 31 on each horizontal line, bringing the transistor TR1 into conduction, whereby data voltage is applied to the capacitance element C by the data driver to store the voltage as a charge. As a result, data corresponding to one field is set in all the pixels constituting the LED display device. As shown in FIG. 16(*b*), the ramp voltage generating circuit maintains a high voltage value during the first half scanning period of every field period and generates during the second half luminescence period thereof a ramp voltage linearly varying from a low voltage value to a high voltage value. During the first half scanning period, the high voltage from the ramp voltage generating circuit is applied to the non-inversion input terminal of the comparator 32. This causes the comparator 32 to always deliver a high output as shown in FIG. 16(*c*) despite the input voltage to the inversion input terminal thereof. When the circuit applies the ramp voltage to the non-inversion input terminal of the comparator 32 in the second half luminescence period, the output voltage (data voltage) of the capacitance element C is simultaneously applied to the inversion input terminal of the comparator 32. This gives one of two values of high and low as shown in FIG. 16(*c*) to the output of the comparator 32 in accordance with the result of comparison of the two voltages. Stated more specifically, the output of the comparator is low while the ramp voltage is lower than the data voltage, whereas the output of the comparator is high while the ramp voltage is higher than the data voltage. The length of the period during which the comparator output is low is in proportion to the magnitude of the data voltage. Thus, the output of the comparator 32 is low during a period proportional to the magnitude of the data voltage, whereby the drive transistor TR2 is held on only during this period, holding the EL element 30 on. Consequently, the organic EL element 30 constituting each pixel 31 luminesces only for a period proportional to the magnitude of the data voltage for the pixels 31, within the period of one field, whereby multi-level gradation can be realized.

However, the organic LED display device described has the problem that the organic EL characteristics are shifted due to change with temperature and time of the organic EL element, as shown in FIG. 17, causing a point of operation to be shifted, whereby a luminance is varied. That is, when the organic EL characteristics are shifted rightward due to the change with temperature and time of the organic EL element, current to be passed through the organic EL element decreases, to thereby decrease the luminance, as illustrated. On the other hand, when the organic EL characteristics are shifted leftward, current to be passed through the organic EL element increases, to thereby increase the luminance, as illustrated.

Incidentally, a light emission device is proposed for obtaining a constant luminance, which the device corrects the voltage for a pixel portion so that a drive current to be passed through a light emission element for the entire pixel portion is a reference value calculated from data of a video signal (JP-A No.311898/2002).

SUMMARY OF THE INVENTION

An object of the present invention is to provide a display device which is adapted to produce a constant luminance despite change with temperature and time of a display element, such as an organic EL element.

The present invention provides a first display device comprising a display panel having an arrangement of a plurality of pixels and a control unit for supplying data voltage or data current corresponding to a video signal fed from the outside to each pixel of the display panel, each pixel of the display panel comprising a display element operable to luminesce when supplied with current and drive means for supplying to the display element a drive current corresponding to the data voltage or the data current from the control unit. The control unit comprises:

deriving means for deriving the sum of currents to be passed through each pixel of the display panel based on values of the video signals for each pixel of the display panel, current measuring means for measuring the total quantity of currents to have been passed through the pixels of the display panel, and calculation processing means for correcting the video signals for each pixel of the display panel based on a derived value obtained by the deriving means and a measurement value obtained by the current measuring means.

With the first display device of the present invention, the calculation processing means corrects the video signals for each pixel. At this time, current variations due to change with temperature and time of the display element can be indicated by the difference between the sum of currents theoretically derived by the deriving means based on the value of the video data and the total quantity of currents actually measured by the current measuring means. Accordingly the video signals are corrected by the calculation processing means in accordance with the change with temperature and time. Thus the video signals are corrected for each pixel in accordance with the change with temperature and time, the data voltage or the data current corresponding to the corrected video signal is fed to each pixel, and the drive current corresponding to the data voltage or the data current is fed to the display element. Consequently the display element luminesces with a constant luminance despite the change with temperature and time.

Stated specifically, the deriving means comprises accumulating means for accumulating the values of the video signals for each pixel of the display panel, and conversion means for converting an accumulated value obtained by the accumulating means into the sum of currents to be passed through each pixel of the display panel. The calculation processing means corrects the video signals based on the conversion value obtained by the conversion means and the measurement value obtained by the current measuring means. The calculation processing means comprises correction coefficient calculating means for calculating a correction coefficient based on the conversion value and the measurement value and correcting means for correcting the video signals with use of the calculated correction coefficient.

Stated specifically, the correcting means varies the calculated correction coefficient depending on a position of the pixel.

The display element is more prone to temperature increase in a central portion of a display area of the display panel than in a peripheral portion, and is more rapidly deteriorated thereof. Therefore current variations due to the change with temperature and time of the display element in the central portion are greater than in the peripheral portion. The correcting means varies the correction quantity by varying the correction coefficient depending on a position of the pixel, whereby a suitable correction in accordance with the change with temperature and time can be made to the video signals despite the position of the pixel.

According to another specific construction, a display area of the display panel can be divided into a plurality of areas. The correction coefficient can be calculated for each of the areas. The plurality of areas are each set to a correction coefficient calculating area one after another. The control unit comprises video signal setting means for performing an operation for setting the values of the video signals for the pixels in areas except the correction coefficient calculating area to a predetermined value such that the magnitude of the drive current to be fed to the display elements of the pixels is zero. When the video signal setting means performs a setting operation, the accumulating means performs the accumulating operation, and the current measuring means performs the measuring operation. Then the correction coefficient calculating means of the calculation processing means calculates the correction coefficient for each of the areas. The correcting means corrects the video signals for the pixels in each of the areas with use of the correction coefficient for each of the areas.

According to the specific construction, the display area of the display panel is divided into the plurality of areas, and the correction coefficient is calculated for each of the areas. First, one area out of the plurality of areas is set to the correction coefficient calculating area. The values of the video signals for the pixels in areas except the correction coefficient calculating area are set to a predetermined value such that the magnitude of the drive current to be fed to the display elements of the pixels is zero, which predetermined value is zero, for example. As a result, the drive current is fed to the display elements of the pixels only in the correction coefficient calculating area to display the video image only in the correction coefficient calculating area. At this time, the accumulating means performs the accumulating operation, and thereafter the conversion means performs a conversion operation, to obtain the sum of currents to be passed through each pixel in the correction coefficient calculating area. Furthermore, the current measuring means performs the measurement operation, to obtain the total quantity of currents to have been passed through the pixels in the correction coefficient calculating area. The current variations due to the change with temperature and time of the pixels arranged in the correction coefficient calculating area can be indicated by the difference between the conversion value obtained by the conversion means and the measurement value obtained by the current measuring means, as described above. The correction coefficient calculating means calculates the correction coefficient for the area based on the conversion value and the measurement value. As in the same manner, the correction coefficients for other areas are each calculated one after another. The correction coefficient for each of the areas is thus calculated, and the video signals for the pixels in each of the areas are corrected with the correction coefficient for each of the areas. According to the specific construction, the suitable correction in accordance with the change with temperature and time can be made to the video signals despite the position of the pixel.

Stated further specifically, the correction coefficient can be calculated for each color of the three primary colors. The three primary colors are each set to a correction coefficient calculating color one after another. The video signal setting means sets to said predetermined value the values of the video signals for the pixels of the two colors except the correction coefficient calculating color, among the pixels in the correction coefficient calculating area. The correction coefficient calculating means of the calculation processing means calculates the correction coefficient for each color. The correcting means corrects the video signals for each color pixel with use of the correction coefficient for each color.

According to the construction described, the correction coefficient is calculated for each of the areas and for each color of the three primary colors. As described above, the values of the video signals for the pixels in the areas except the correction coefficient calculating area are set to said predetermined value. One of the three primary colors is set to the correction coefficient calculating color. The values of the video signals for the pixels except the pixels of the correction coefficient calculating color and among the pixels in the correction coefficient calculating area are set to said predetermined value. As a result, the drive current is fed to the display elements of the pixels of the correction coefficient calculating color and among the pixels in the correction coefficient calculating area to display the video image only in said area only with said pixels of said color. At this time the accumulating means performs an accumulating operation, and thereafter the conversion means performs a conversion operation, to obtain the sum of currents to be passed through each pixel of the correction coefficient calculating color and among the pixels in the correction coefficient calculating area. The current measuring means further performs a measurement operation to obtain the total quantity of currents to have been passed through the pixels of the correction coefficient calculating color among the pixels in the correction coefficient calculating area. Incidentally the current variations due to the change with temperature and time of the pixels of the correction coefficient calculating color and among the pixels in the correction coefficient calculating area can be indicated by the difference between the conversion value obtained by the conversion means and the measurement value obtained by the current measuring means, as described above. Thus the correction coefficient calculating means calculates the correction coefficient for said color based on the conversion value and the measurement value. As in the same manner, the correction coefficients for the other two colors are each calculated one after another. Thus the correction coefficient for each color in each of the areas is calculated to correct the video signals for each color pixel in each of the areas with use of each correction coefficient.

Stated further specifically, the control unit comprises relationship means for defining for each color the relationships between the accumulated value of the video signals and the sum of currents. The conversion means converts the accumulated value of the video signals into the sum of currents according to the relationship for the correction coefficient calculating color and among the relationships defined in the relationship means.

According to the specific construction described, the accumulated value of the video signals is converted into the sum of currents according to the relationship for the correction coefficient calculating color and among the three relationships defined in the relationship means, so that an accurate conversion value in accordance with luminous efficiency of the pixels of said color can be obtained. Therefore a suitable correction in accordance with the change with temperature and time can be made to the video signals despite the color of the pixel.

According to another specific construction, a display area of the display panel is divided into a plurality of areas, and the correction coefficient can be calculated for each of the areas. The plurality of areas are each set to the correction coefficient calculating area one after another. The control unit comprises video signal setting means for performing an operation for setting the values of the video signals for the pixels in said area to a value such that the magnitude of the drive current to be fed to the display elements of said pixels is zero or a given predetermined value. When the video signal setting means performs a setting operation or ceases a setting operation, the accumulating means performs the accumulation operation while the current measuring means performs the measurement operation. The calculation processing means further comprises:

first subtraction means for subtracting a conversion value obtained when the video signal setting means performs a setting operation from a conversion value obtained when the video signal setting means ceases a setting operation, and second subtraction means for subtracting a measurement value obtained when the video signal setting means performs a setting operation from a measurement value obtained when the video signal setting means ceases a setting operation. The correction coefficient calculating means calculates a correction coefficient for each of the areas based on the subtraction result obtained by the first subtraction means and the subtraction result obtained by the second subtraction means. The correcting means corrects the videos signals for the pixels in each of the areas with use of the correction coefficient for each of the areas.

According to the specific construction, the display area of the display panel is divided into a plurality of areas, and the correction coefficient is calculated for each of the areas. First, one area among the plurality of areas is set to the correction coefficient calculating area. The values of the video signals for the pixels in said area are set to a value such that the magnitude of the drive current to be fed to the display elements of said pixels is zero, for example. As a result, the drive current is fed to the display elements of the pixels arranged in the areas except the correction coefficient calculating area, to display the video image in the areas except the correction coefficient calculating area. At this time, the accumulating means performs an accumulating operation, and thereafter the conversion means performs a conversion operation to obtain the sum of currents to be passed through each pixel in the areas except the correction coefficient calculating area. Furthermore, the current measuring means performs a measurement operation to obtain the total quantity of currents to have been passed through the pixels in the areas except the correction coefficient calculating area.

Furthermore, when the video signal setting means ceases the setting operation described, the accumulating means performs an accumulating operation, and thereafter the conversion means performs a conversion operation to obtain the sum of currents to be passed through each pixel in all of the areas of the display panel. Further, the current measuring means performs a measurement operation to obtain the quantity of currents to have been passed through the pixels in all of the areas of the display panel.

The sum of currents to be passed through each pixel in the correction coefficient calculating area can be indicated by the difference between the conversion value obtained when the video signal setting means ceases a setting operation and the conversion value when performs a setting operation as described above. Further the total quantity of currents to have been passed through the pixels in the correction coefficient calculating area can be indicated by the difference between the measurement value obtained when the video signal setting means ceases a setting operation and the measurement value obtained when performs a setting operation as described above. The first subtraction means calculates the sum of currents to be passed through each pixel in the correction coefficient calculating area. The second subtraction means calculates the total quantity of currents to have been passed through the pixels in the correction coefficient calculating area. In this case, the current variations due to the change with temperature and time of the pixels arranged in the correction coefficient calculating area can be indicated by the difference between the subtraction result obtained by the first subtraction means and the subtraction result obtained by the second subtraction means. Thus the correction coefficient calculating means calculates the correction coefficient for said area based on the subtraction results. As in the same manner, the correction coefficients for the other areas are each calculated one after another. The correction coefficient for each of the areas is thus calculated to correct the video signals for the pixels in each of the areas with use of the correction coefficient for each of the areas. According to the specific construction described, a suitable correction in accordance with the change with temperature and time can be made to the video signals despite the position of the pixel.

Further stated specifically, the correction coefficient can be calculated for each color of the three primary colors. The three primary colors are each set to the correction coefficient calculating color one after another. The video signal setting means sets the values of the video signals for the pixels of said color and among pixels in the correction coefficient calculating area to a value such that the magnitude of the drive current to be fed to the display element of said pixels is zero or a given predetermined value. The correction coefficient calculating means of the calculation processing means calculates a correction coefficient for each color. The correcting means corrects the video signals for each color pixel with use of the correction coefficient for each color.

According to the specific construction, the correction coefficient is calculated for each of the areas and for each color of the three primary colors. Owing to a subtraction operation of the first subtraction means, the sum of currents to be passed through each pixel of the correction coefficient calculating color and among the pixels in the correction coefficient calculating area. Furthermore, owing to a subtraction operation of the second subtraction means, the total quantity of currents to have been passed through the pixels of the correction coefficient calculating color and among the pixels in the correction coefficient calculating area. In this case the current variations due to the change with temperature and time of the pixels of the correction coefficient calculating color and among the pixels in the correction coefficient area can be indicated by the difference between the subtraction result obtained by the first subtracting means and the subtraction result obtained by the second subtracting means. The correction coefficient calculating means calculates the correction coefficient for said color based on the subtraction results.

Stated further specifically, the control unit comprises relationship means for defining for each color the relationships between the accumulated value of the video signals and the sum of currents. The accumulating means accumulates, for each color, the values of the video signals. The conversion means converts, for each color, the accumulated value of the video signals into the sum of currents according to the relationships defined in the relationship means.

According to the specific construction described, the accumulated value of the video signals is converted, for each color, into the sum of currents according to the relationship defined in the relationship means, so that an accurate conversion value can be obtained for each color in accordance with luminous efficiency of the pixel. Therefore, a suitable correction in accordance with the change with temperature and time can be made to the video signals despite the color of the pixel.

Still further specifically, the video signal setting means performs the setting operation at a longer cycle than a frame cycle of the video signal.

Because the change with temperature and time of the display element is slow, a new correction coefficient need not be calculated at the same cycle as the frame cycle of the video signal. The suitable correction in accordance with the change with temperature and time can be made to the video signals by the use of the correction coefficient calculated at a longer cycle than the frame cycle. According to the specific construction described, the cycle of the setting operation of the video signal setting means is set to the cycle described. This can suppress a flicker in the screen.

The present invention provides a second display device comprising a display panel having an arrangement of a plurality of pixels and a control unit for supplying data voltage or data current corresponding to a video signal fed from the outside to each pixel of the display panel, each pixel of the display panel comprising a display element operable to luminesce when supplied with current and drive means for supplying to the display element drive current corresponding to the data voltage or the data current from the control unit. The control unit comprises:

deriving means for deriving the sum of currents to be passed through each pixel of the display panel based on values of the video signals for each pixel of the display panel, current measuring means for measuring the total quantity of currents to have been passed through pixels of the display panel, control means for preparing and outputting a control signal based on a derived value obtained by the deriving means and a measurement value obtained by the current measuring means, and data voltage/current supplying means for changing the relationship between the video signal and the data voltage or the data current according to the control signal output from the control unit, and supplying to each pixel of the display panel the data voltage or the data current corresponding to the video signal from the outside based on the changed relationship.

With the second display device of the present invention, the control means prepares the control signal for the data voltage/current supplying means. Current variations due to the change with temperature and time of the display element can be indicated by the difference between the sum of currents theoretically derived by the deriving means from the value of the video signal, and the quantity of currents actually measured by the current measuring means. Accordingly the control means prepares the control signal in accordance with the change with temperature and time. The control signal thus prepared is supplied to the data voltage/current supplying means, to change the relationship between the video signal and the data voltage or data current, supplying to each pixel the data voltage or the data current corresponding to the video signal in accordance with the changed relationship, to supply to the display element the drive current corresponding to said data voltage or said data current. Consequently, the display element luminesces with a constant luminance despite the change with temperature and time.

As stated above, with the first and the second display devices of the present invention, a constant luminance can be achieved despite the change with temperature and time of the display element.

DETAILED DESCRIPTION OF THE INVENTION

With reference to the drawings, the present invention will be described below as embodied into organic LED display devices based on two embodiments.

FIRST EMBODIMENT

Figure 1:
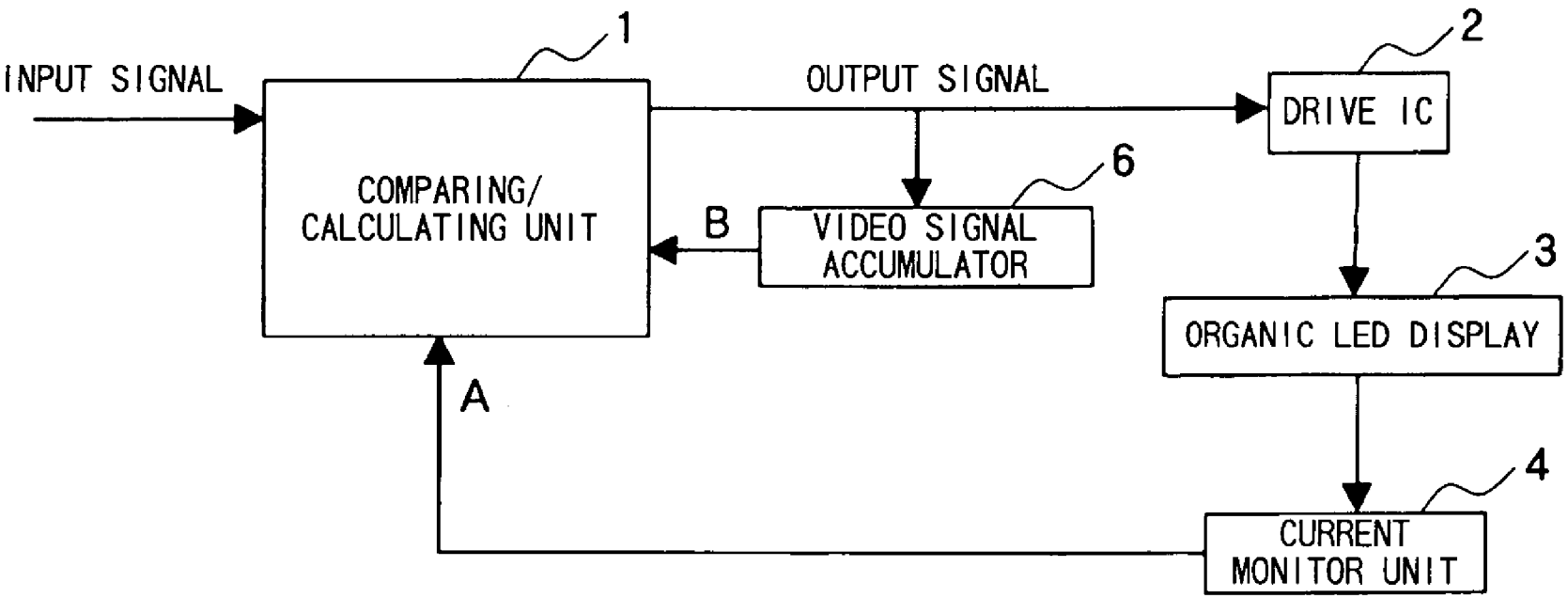
FIG. 1 is a block diagram showing the construction of an organic LED display device of the first embodiment.

FIG. 1 shows an organic LED display device of the present embodiment. A video signal from a video source such as a TV receiver is fed to an A/D converter which is not shown, converted into digital data, and thereafter fed to a comparing/calculating unit 1 for processing the signal and correcting the signal as required for video display as will be stated below. The video data of RGB three primary colors thus obtained is fed to a drive IC 2. Data voltage corresponding to the data is fed to each pixel of an organic LED display 3. Drive current corresponding to the data voltage is fed to an organic EL element of each pixel to cause the organic EL element to luminesce.

Figure 3:
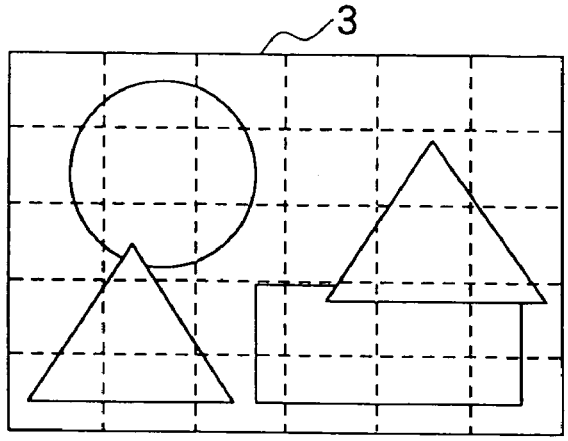
FIG. 3 is a diagram showing an example of a screen displayed on an organic LED display.

The organic LED display device of the present embodiment is adapted to divide a display area of the organic LED display 3 into a plurality of areas as indicated in a broken line in FIG. 3, and to make a correction to the video data for each of the areas and for each color of the RGB three primary colors. The comparing/calculating unit 1 performs a data changing operation which will be described below for calculating a correction gain used for the correction.

Figure 4:
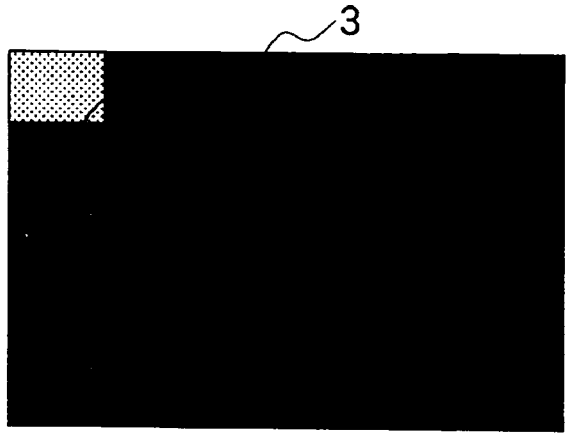
FIG. 4(*a*) and FIG. 4(*b*) are diagrams showing examples of screens displayed on the organic LED display for the calculation of a correction gain.
Figure 4:
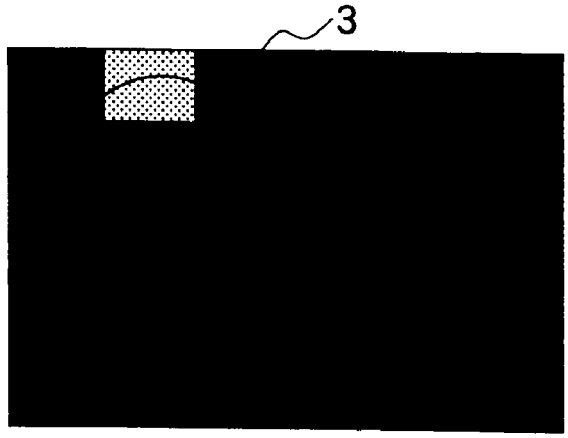

First, among input data of one frame, the video data for the pixels in the areas except a first area and the video data for the pixels of G and B in the first area are each changed to the value of zero, with the result that currents are passed only through the pixels of R among pixels arranged in the first area of the organic LED display 3 to display video image only in the first area only with the pixels of R, as shown in FIG. 4(*a*). Subsequently among input data for one frame, the video data for the pixels in the areas except the first area and the video data for the pixels of R and B in the first area are each changed to the value of zero, with the result that currents are passed only through the pixels of G among pixels arranged in the first area of the organic LED display 3 to display video image only in the first area only with the pixels of G. Subsequently among input data for one frame, the video data for the pixels in the areas except the first area and the video data for the pixels of R and G in the first area are each changed to the value of zero, with the result that currents are passed only through the pixels of B among the pixels arranged in the first area of the organic LED display 3 to display video image only in the first area only with the pixels of B. As in the same manner, video image is thereafter displayed one after another only in the second area with each color pixel as shown in FIG. 4(*b*). Subsequently video image is displayed one after another in each of the areas from the third area to the last area with each color pixel, and video image is thereafter displayed one after another only in the first area with each color pixel again. Accordingly the video image is repeatedly displayed in each of the areas from the first to the last areas with each color pixel. A frame cycle of the video signal is set, for example, to 1/60 second. The comparing/calculating unit 1 performs the data changing operation described at a cycle of one second which is longer than the frame cycle. Accordingly, in this case the frame video images shown in FIG. 4(*a*) and FIG. 4(*b*) are included at a rate of one in 60 frame video images.

Current flowing to a connector (not shown) through each pixel of the organic LED display 3 shown in FIG. 1 is fed to a current monitor unit 4 housing A/D converter (not shown). The sum of currents to have been passed through each pixel is calculated in the current monitor unit 4, and the calculation result is fed to the comparing/calculating unit 1.

Figure 2:
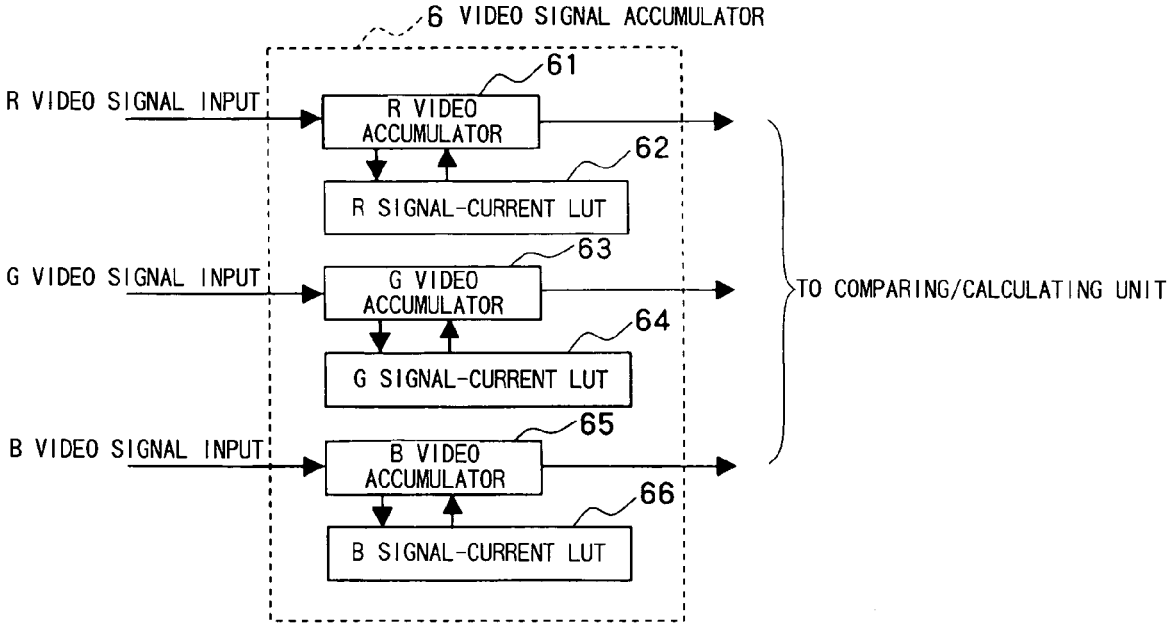
FIG. 2 is a block diagram showing the construction of a video signal accumulator of the organic LED display device.

Furthermore, the video data of RGB having a value changed by the comparing/calculating unit 1 as described above is fed to a video signal accumulator 6. The video data of RGB is fed to an R video accumulator 61, G video accumulator 63, and B video accumulator 65, respectively, as shown in FIG. 2, and calculated only for one frame. The R video accumulator 61, G video accumulator 63, and B video accumulator 65 are respectively connected to lookup tables 62, 64, 66 in which the relationship between the value of the video data and the current passing through the pixel is defined. The video accumulators respectively refer to the lookup tables to thereby convert the accumulated value of the video data for each color pixel into the sum of currents to be passed through each color pixel. The conversion result is fed to the comparing/calculating unit 1 shown in FIG. 1.

Current variations due to change with temperature and time of the organic EL element can be indicated by the difference between total quantity of currents actually measured by the current monitor unit 4 and the sum of currents theoretically derived by the video signal accumulator 6 based on the accumulated value of the video data, as described above. In the comparing/calculating unit 1, the conversion result B of the video signal accumulator 6 is divided by the calculation result A of the current monitor unit 4 to thereby calculate a correction gain (B/A). Thereafter the input data is multiplied by the correction gain to thereby make a correction to the input data.

Figure 5:
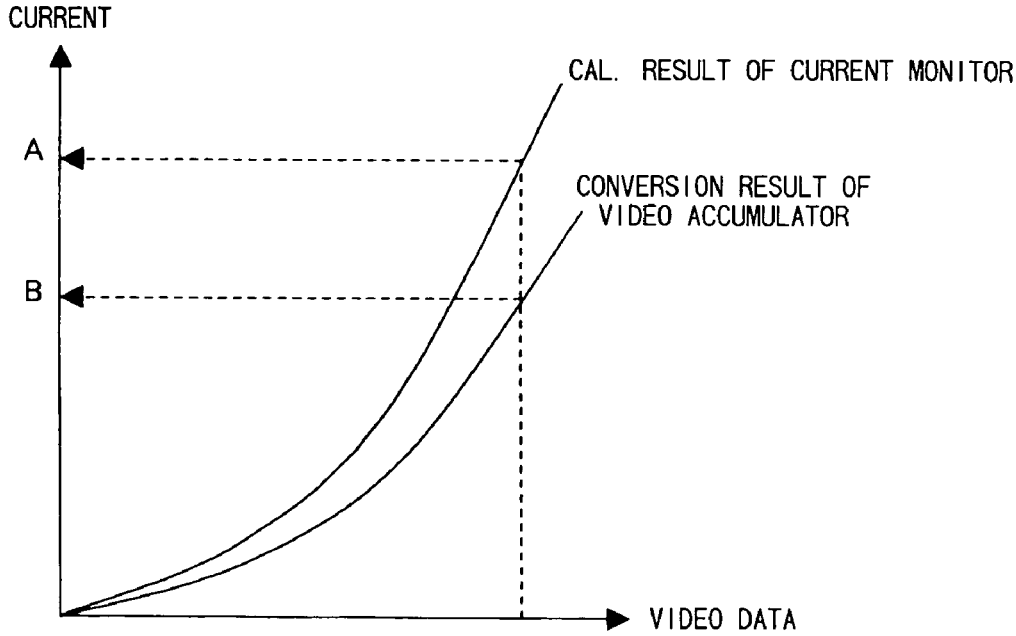
FIG. 5 is a graph showing the relationship between video data and a current to be passed through an organic EL element.
Figure 6:
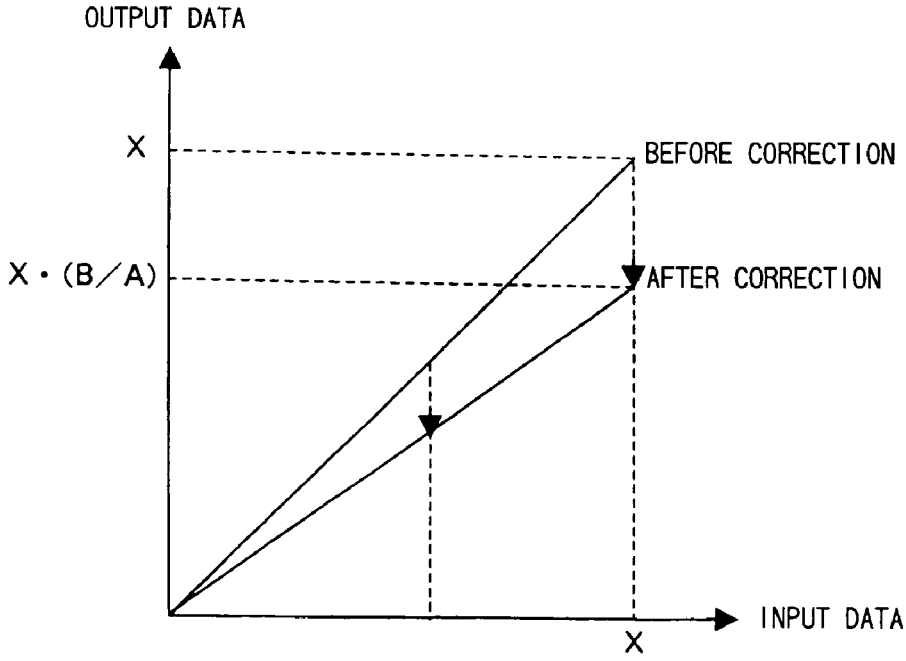
FIG. 6 is a graph showing the relationship between input data and output data of a comparing/calculating unit with the organic LED display.

For example, when the organic EL element rises in temperature, the calculation result A of the current monitor unit 4 exceeds the conversion result B of the video accumulator 6 as shown in FIG. 5 to make the correction gain (B/A) smaller than one, correcting the input data X to data [X·(B/A)] which is smaller than the data X as shown in FIG. 6.

Accordingly the input data is corrected in accordance with the change with temperature and time of the organic EL element to feed the corrected data to the drive IC 2. Thus the data voltage corresponding to the data is fed to the pixels of the organic LED display 3, to feed the drive current corresponding to the data voltage to the organic EL elements. Consequently the organic EL element luminesces with a constant luminance despite the change with temperature and time.

The correction gain described is calculated when the frame video images as shown in FIG. 4(*a*) and FIG. 4(*b*) are displayed on the organic LED display 3. When video image is displayed only in the first area only with the pixels of R as shown in FIG. 4(*a*), the sum of currents to be passed through each pixel of R in the first area is obtained from the video signal accumulator 6, and the sum of currents to have been passed through each pixel of R in the first area is obtained from the current monitor unit 4. Incidentally current variations due to the change with temperature and time of the pixels of R arranged in the first area can be indicated by the difference between the value obtained from the current monitor unit 4 and the value obtained from the video signal accumulator 6, as described above. Therefore the correction gain for the pixels of R in the first area is obtained in the comparing/calculating unit 1. Thereafter when the video image is displayed only in the first area only with the pixels of G, the correction gain for the pixels of G in the first area is obtained. When the video image is displayed only in the first area only with the pixels of B, the correction gain for the pixels of B in the first area is obtained. When the video image is displayed only in the second area only with the pixels of R, the correction gain for the pixels of R in the second area is obtained as seen in FIG. 4(*b*), so on so forth. The correction gain for each color in each area is obtained one after another. The correction gain for each color in each area thus obtained is multiplied by the video data for each color pixel in each area, to correct the video data for each area and for each color.

With the organic LED display device of the present embodiment, as described above, the video data for each pixel is corrected in accordance with the change with temperature and time of the organic EL element to thereby achieve a constant luminance despite the change with temperature and time.

Whereas the display area of the organic LED display 3 is divided into a plurality of areas to calculate the correction gain for each color in each area in the embodiment described above, it is also possible to calculate the correction gain for each color not by dividing the display area of the organic LED display 3 into a plurality of areas.

Figure 7:
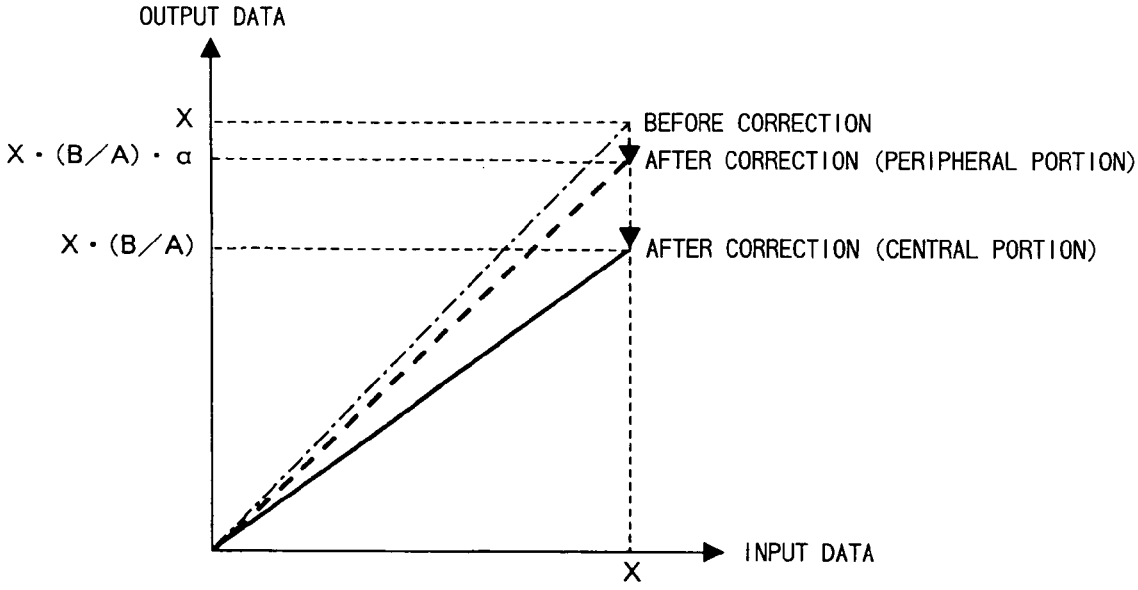
FIG. 7 is a graph showing the relationship between input data and output data of comparing/calculating unit for varying the correction gain depending on a position of a pixel.

Furthermore, the construction to be described below is also available: the correction gain (B/A) for each color is calculated not by dividing the display area of the organic LED display 3 into a plurality of areas, the video data for the pixels in a central portion which have a great temperature change is multiplied by the correction gain (B/A) while the video data for the pixels in a peripheral portion which have a small temperature change is multiplied by a new correction gain obtained by multiplying the correction gain (B/A) by a coefficient $\alpha$ ($\alpha>1$) as shown in FIG. 7.

Furthermore, when the sum of currents to be passed through each pixel is to be derived based on the accumulated value of the video data, taking into account of the voltage drop due to the wiring resistance generates a derived value with high accuracy.

Further, the correction gain can be varied smoothly in the vicinity of the boundary of two adjacent areas by weighting the correction gain calculated for each area with use of a weighted coefficient. This prevents the occurrence of luminance difference in the boundary between two adjacent areas.

Furthermore, whereas the present invention is embodied into the organic LED display device wherein the data voltage is fed from the drive IC 2 to the organic LED display 3 according to the embodiment described above, the invention can also be embodied into an organic LED display device wherein the data current is fed thereof.

Figure 8:
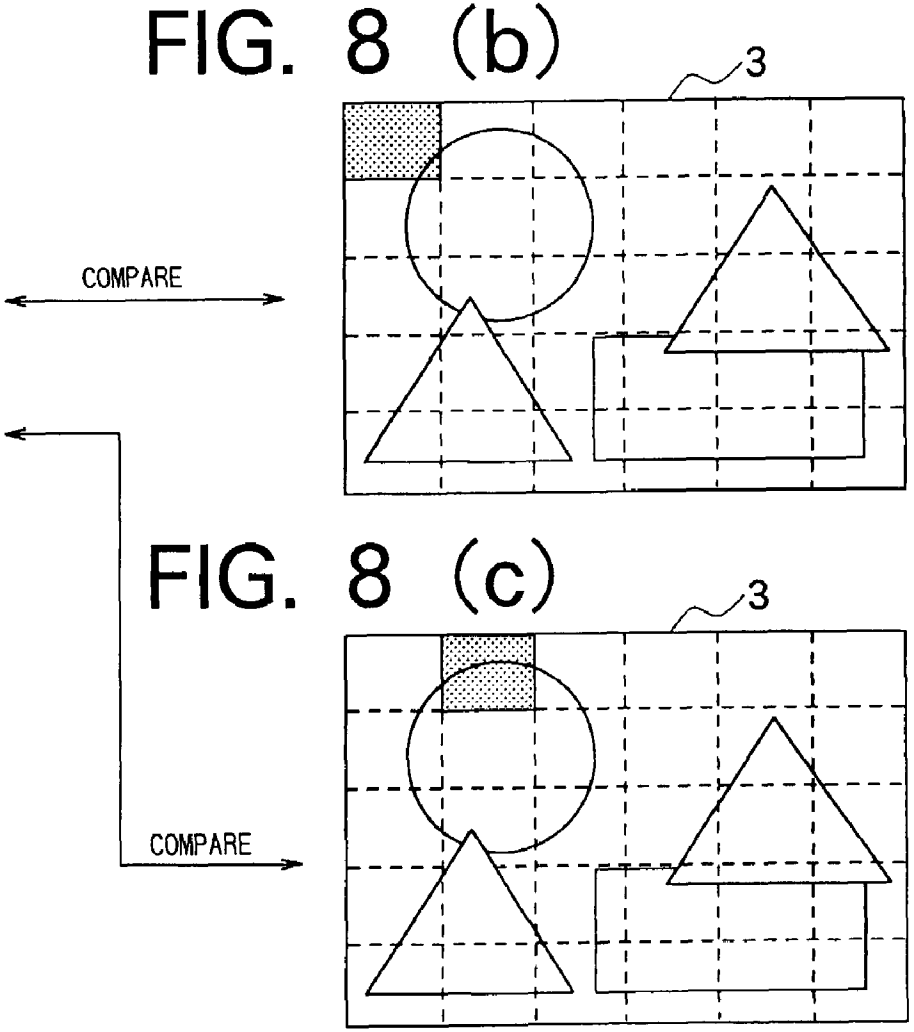
FIGS. 8(*a*) to (*c*) are diagrams showing another example of screens displayed on the organic LED display for the calculation of the correction gain.

Furthermore, according to the embodiment described above, when, for example, the correction gain for the pixels of R in the first area is to be calculated, video image is displayed only in the first area only with the pixels of R as shown in FIG. 4(*a*) to calculate the sum A of currents to have been passed through each pixel of R in the first area and to derive the sum B of currents to be passed through each pixel of R in the first area based on an accumulated value of the video data. These values A, B can also be obtained with a method to be described below. When the video image is displayed in all of the display areas of the organic LED display 3 with the RGB pixels as shown in FIG. 8(*a*), the sum $A_0$ of currents to have been passed through each pixel in all of the areas is calculated, and the sum $B_0$ of currents to be passed through each pixel in all of the areas is derived based on the accumulated value of the video data. Thereafter, the video data for the pixels of R in the first area is changed to the value of zero to thereby display the video image with the pixels except the pixels of R in the first area as seen in FIG. 8(*b*), to calculate the sum $A_1$ of currents to have been passed through each pixel except the pixels of R in the first area, and to derive the sum $B_1$ of currents to be passed through each pixel except the pixels of R in the first area based on the accumulated value of the video data. Thereafter the sum $A_1$ of currents to have been passed through each pixel except the pixels of R in the first area is subtracted from the sum $A_0$ of currents to have been passed through each pixel in all of the areas. Thus obtained is the sum A ($A=A_0-A_1$) of currents to have been passed through each pixel of R in the first area when the video image is displayed in all of the display areas with the RGB pixels as shown in FIG. 8(*a*). Furthermore, the sum $B_1$ of currents to be passed through each pixel except the pixels of R in the first area is subtracted from the sum $B_0$ of currents to be passed through each pixel in all of the areas. Thus obtained is the sum B ($B=B_0-B_1$) of currents to be passed through each pixel of R in the first area when the video image is displayed in all of the display areas with the RGB pixels as shown in FIG. 8(*a*). Thereafter when the correction gain for the pixels of R in the second area is to be calculated, the video image is displayed with the pixels except the pixels of R in the second area, as shown in FIG. 8(*c*), to obtain the sum A of currents to have been passed through each pixel of R in the second area and the sum B of currents to be passed through each pixel of R in the second area, as in the same manner described. According to the specific construction, in the calculation of the correction gain, the organic EL elements only in the area for which the correction gain is to be calculated is set to be unlit, to render the area dim, as shown in FIGS. 8(*b*) and 8(*c*), whereby a screen flicker is suppressed. According to the specific construction, when, for example, the correction gain for the pixels of R in the first area is to be calculated, the video data for the pixels of R in the first area is changed to the value of zero, but it is possible to use the arrangement wherein the video data is changed to a given predetermined value.

SECOND EMBODIMENT

With the organic LED display device of the first embodiment, the video data is corrected corresponding to the change with temperature and time. With the organic LED display device of the present embodiment, the relationship between the video data and the data voltage is changed.

Figure 9:
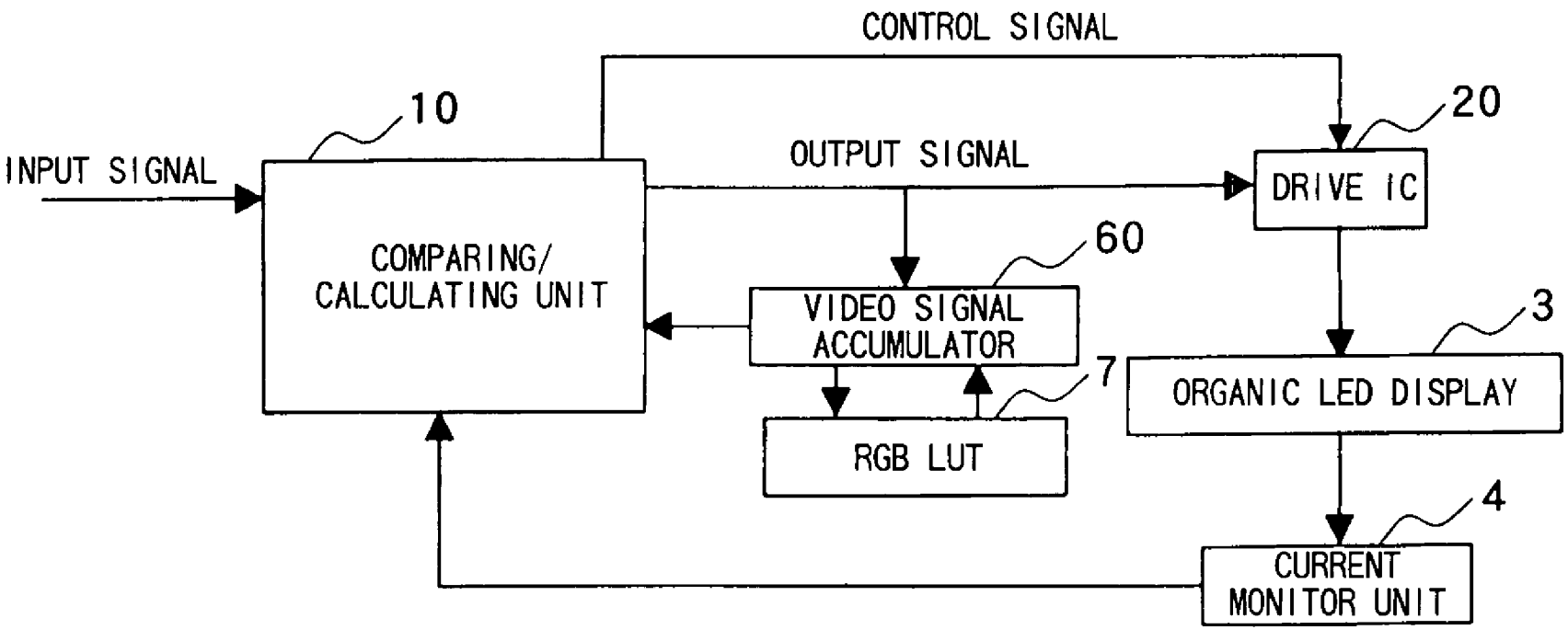
FIG. 9 is a block diagram showing the construction of an organic LED display device of the second embodiment.

FIG. 9 shows an organic LED display device of the present embodiment. A video signal from a video source such as a TV receiver is fed to an A/D converter which is not shown, converted into digital data, and thereafter fed to a comparing/calculating unit 10 for processing the signal and correcting the signal as required for video display. The 8-bit-long video data of RGB three primary colors thus obtained is fed to a drive IC 20. The drive IC 20 changes the relationship between the video data and the data voltage based on a control signal obtained from the comparing/calculating unit 10, as will be described later. In accordance with the changed relationship, the data voltage corresponding to the video data is fed to each pixel of an organic LED display 3. Drive current corresponding to the data voltage is fed to an organic EL element of each pixel to cause the organic EL element to luminesce.

With the organic LED display device of the present embodiment, the comparing/calculating unit 10 performs a data changing operation to be described below for preparing a control signal for the drive IC 20.

First, among input data of one frame, data for the pixels of G and B is changed to the value of zero, with the result that current is passed only through the pixels of R of the organic LED display 3 to display video image only with the pixels of R. Subsequently among input data of one frame, data for the pixels of R and B is changed to the value of zero, with the result that current is passed only through the pixel of G of the organic LED display 3 to display video image only with the pixel of G. Subsequently among input data of one frame, the video data for the pixels of R and G is changed to the value of zero, with the result that current is passed only through the pixel of B of the organic LED display 3 to display video image only with the pixels of B. Thereafter video image is displayed only with the pixels of R again. Accordingly the video image is repeatedly displayed with each pixel of RGB. Frame cycle of the video signal is set, for example, to 1/60 second. The comparing/calculating unit 10 performs the data changing operation described at a cycle of one second which is longer than the frame cycle.

Current flowing to a connector (not shown) through each pixel of the organic LED display 3 is fed to a current monitor unit 4 housing A/D converter (not shown). The sum of currents to have been passed through each pixel is calculated in the current monitor unit 4, and the calculation result is fed to the comparing/calculating unit 10.

Figure 10:
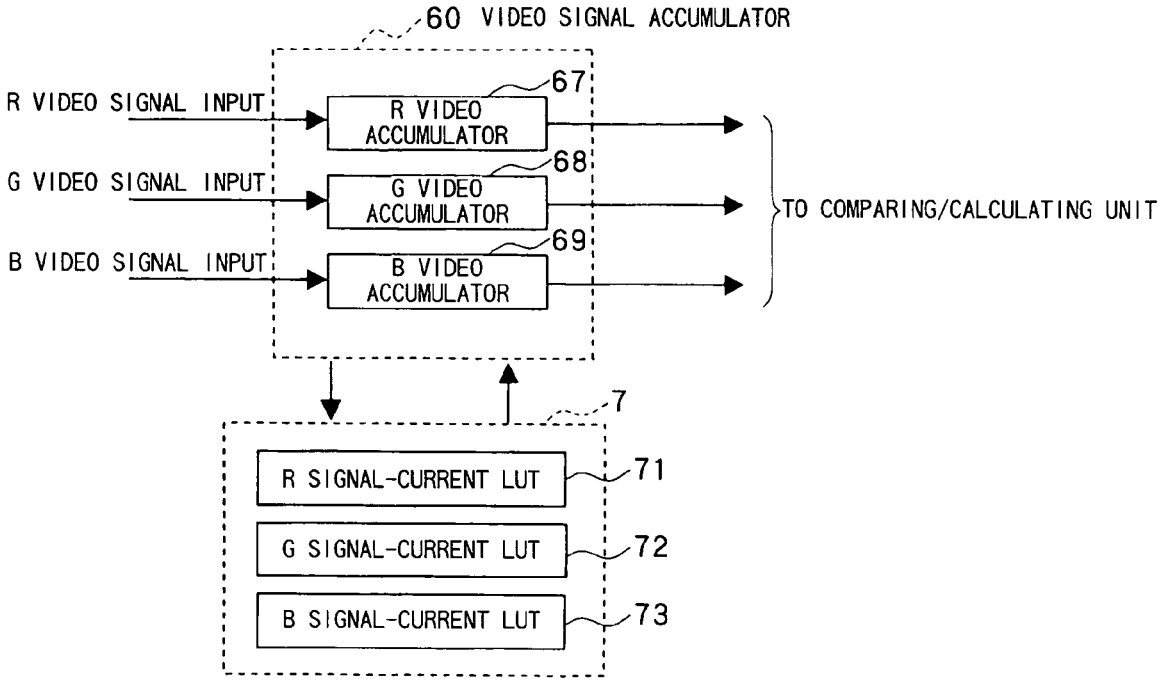
FIG. 10 is a block diagram showing the constructions of video signal accumulators and lookup tables of the organic LED display device.

Furthermore, the video data of RGB output from the comparing/calculating unit 10 as described above is fed to a video signal accumulator 60. The video data of RGB is fed to an R video accumulator 67, G video accumulator 68, and B video accumulator 69, respectively, as shown in FIG. 10, and accumulated only for one frame. The video signal accumulator 60 is connected to a lookup table 7. The lookup table 7 comprises an R-lookup table 71 in which the relationship between the value of the video data and the current to be passed through the pixel of R is defined, a G-lookup table 72 in which the relationship between the value of the video data and the current to be passed through the pixel of G is defined, and a B-lookup table 73 in which the relationship between the value of the video data and the current to be passed through the pixel of B is defined. The video accumulators respectively refers to the lookup tables to thereby convert the accumulated value of the video data for each color pixel into the sum of currents to be passed through each color pixel. The conversion result is fed to the comparing/calculating unit 10.

Current variations due to change with temperature and time of the organic EL element can be indicated by the difference between total quantity of currents actually measured by the current monitor unit 4 and the sum of currents theoretically derived by the video signal accumulator 60 from the accumulated value of the video data, as described above.

In the comparing/calculating unit 10, the conversion result B of the video signal accumulator 60 is divided by the calculation result A of the current monitor unit 4 to thereby calculate a coefficient (B/A). Thereafter a reference voltage Re at that time, i.e., a data voltage when the value of the video data is the maximum value 255, is multiplied by the coefficient to obtain a value [Re·(B/A)]. Then a control signal to the effect that the value [Re·(B/A)] thus obtained is a new reference voltage is prepared and fed to the drive IC 20.

Figure 11:
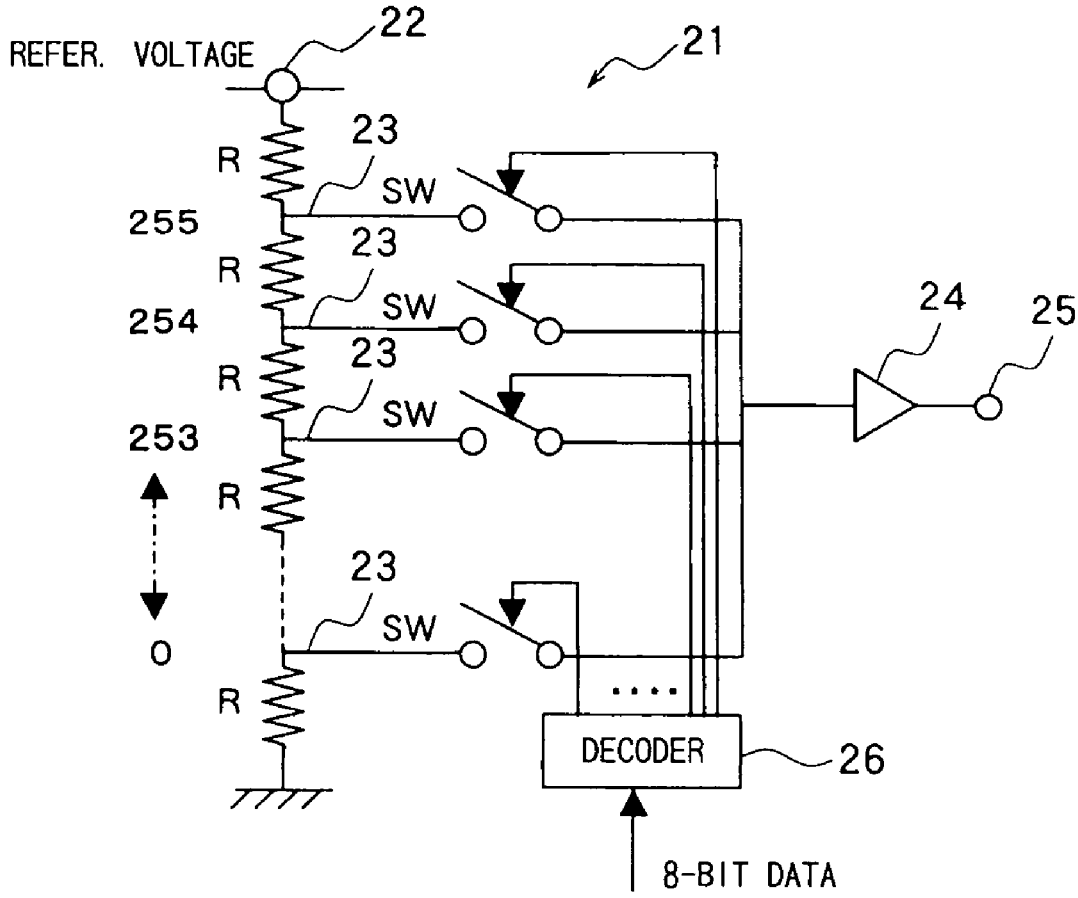
FIG. 11 is a diagram showing the circuit structure of a D/A conversion circuit of a drive IC with the organic LED display device.

The drive IC 20 comprises a D/A conversion circuit 21 for each of the RGB three primary colors and having a construction shown in FIG. 11. With the D/A conversion circuit 21, two hundred and fifty-seven resistance elements R are connected to in series each other. Connected to the resistance element arranged on one end is a voltage input terminal 22 to which the reference voltage is to be applied. The resistance element arranged on the other end is grounded. Two hundred and fifty-six voltage supplying wires 23 extend from joints wherein the resistance elements R are connected to each other. The voltage supplying wires 23 are connected to a voltage output terminal 25 via an amplifier 24. The voltage output terminal 25 is connected to each pixel of the organic EL display. Switching elements SW are respectively interposed on the voltage supplying wires 23. Two hundred and fifty-six switching elements SW are connected to a decoder 26, and on/off-controlled by the decoder 26. With the D/A conversion circuit 21, a reference voltage to be applied to the voltage input terminal 22 is changed corresponding to a control signal fed from the comparing/calculating unit 10, as described above. The numbers 0 to 255 which are the range of the values of the video data are respectively allocated to said 256 switching elements. The decoder 26 decodes 8-bit-long video data fed from the comparing/calculating unit 10, and turns on, from among said 256 switching elements SW, one switching element to which the number corresponding to the decoded result is allocated. Consequently, the reference voltage applied to the voltage input terminal 22 is divided depending on said video data, and the divided voltage is amplified by the amplifier 23, thereafter fed from the voltage output terminal 24 to the pixels of the organic EL display.

Accordingly, the relationship between the video data and the data voltage is changed in accordance with change with temperature and time. The data voltage corresponding to the video data in accordance with the changed relationship is applied to the pixels of the organic LED display to feed a drive current corresponding to the data voltage to the organic EL element. Thus the organic EL element luminesces with a constant luminance despite the change with temperature and time.

Figure 12:
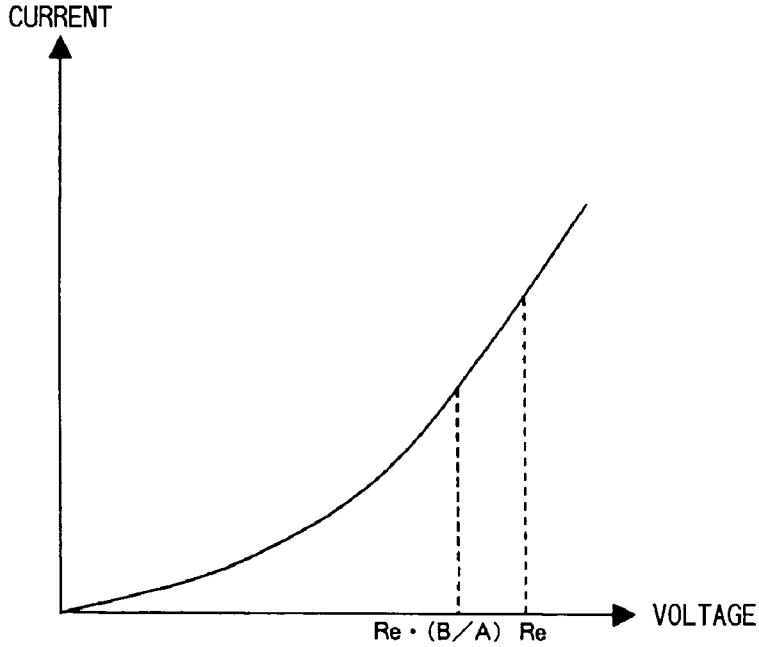
FIG. 12 is a graph showing the relationship between a voltage to be applied to the organic EL element and a current to be passed through the organic EL element.
Figure 13:
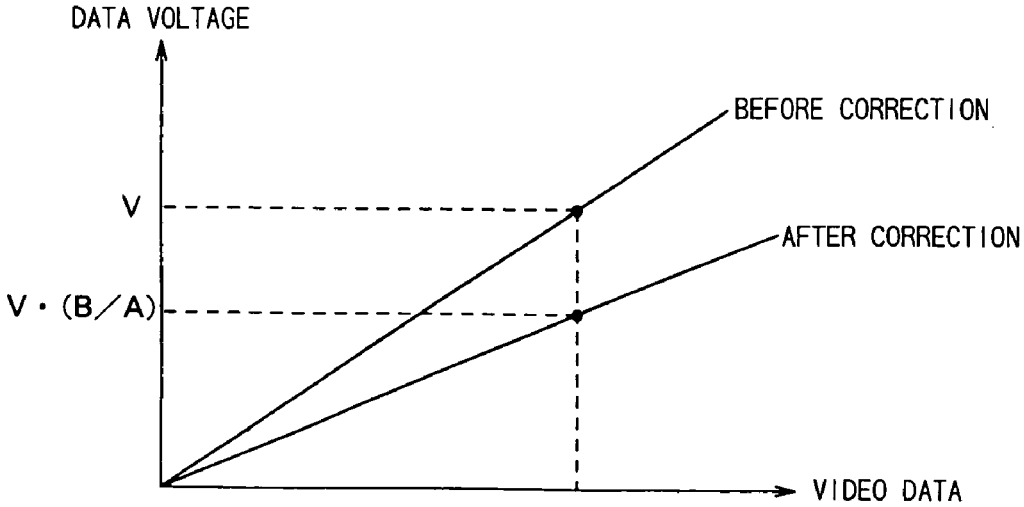
FIG. 13 is a graph showing the relationship between the video data and the data voltage.

For example, when the organic EL element rises in temperature, the calculation result A of the current monitor unit 4 exceeds the conversion result B of the video accumulator 60 as shown in FIG. 5 to make the correction coefficient (B/A) smaller than one. Therefore the reference voltage is set to a value [Re·(B/A)] which is smaller than the value Re at that time, as shown in FIG. 12, with the result that the voltage [V·(B/A)] which is smaller than the data voltage V before the change of the reference voltage is fed from the drive IC 20 to the pixels of the organic LED display 3, as shown in FIG. 13.

The above-mentioned control signal fed to the drive IC 20 is prepared when the video image is displayed on the organic LED display 3 only with the pixels of R, when the video image is displayed on the organic LED display 3 only with the pixels of G, and when the video image is displayed on the organic LED display 3 only with the pixels of B. When the video image is displayed on the organic LED display 3 only with the pixels of R, the sum of currents to be passed through each pixel of R is obtained from the video signal accumulator 60, and the sum of currents to have been passed through each pixel of R is obtained from the current monitor unit 4. In this case current variations due to the change with temperature and time of the pixels of R can be indicated by the difference between the value obtained from the current monitor unit 4 and the value obtained from the video signal accumulator 60, as described above. Accordingly in the comparing/calculating unit 10, a value to be set as the reference voltage for the pixels of R is calculated, and a control signal to the effect that the calculated value is a new reference voltage for the pixels of R is prepared. Thereafter when the video image is displayed on the organic LED display 3 only with the pixels of G, a value to be set as the reference voltage for the pixels of G is calculated, and a control signal to the effect that the calculated value is a new reference voltage for the pixels of G is prepared. Furthermore when the video image is displayed on the organic LED display 3 only with the pixels of B, a value to be set as the reference voltage for the pixels of B is calculated, and a control signal to the effect that the calculated value is a new reference voltage for the pixels of B is prepared. The control signals for each color which are thus obtained are fed to the drive IC 21 to change the reference voltages for each color.

With the organic LED display device of the present embodiment, as described above, the reference voltage is changed in accordance with the change with temperature and time of the organic EL element to thereby achieve a constant luminance despite the change with temperature and time.

Figure 14:
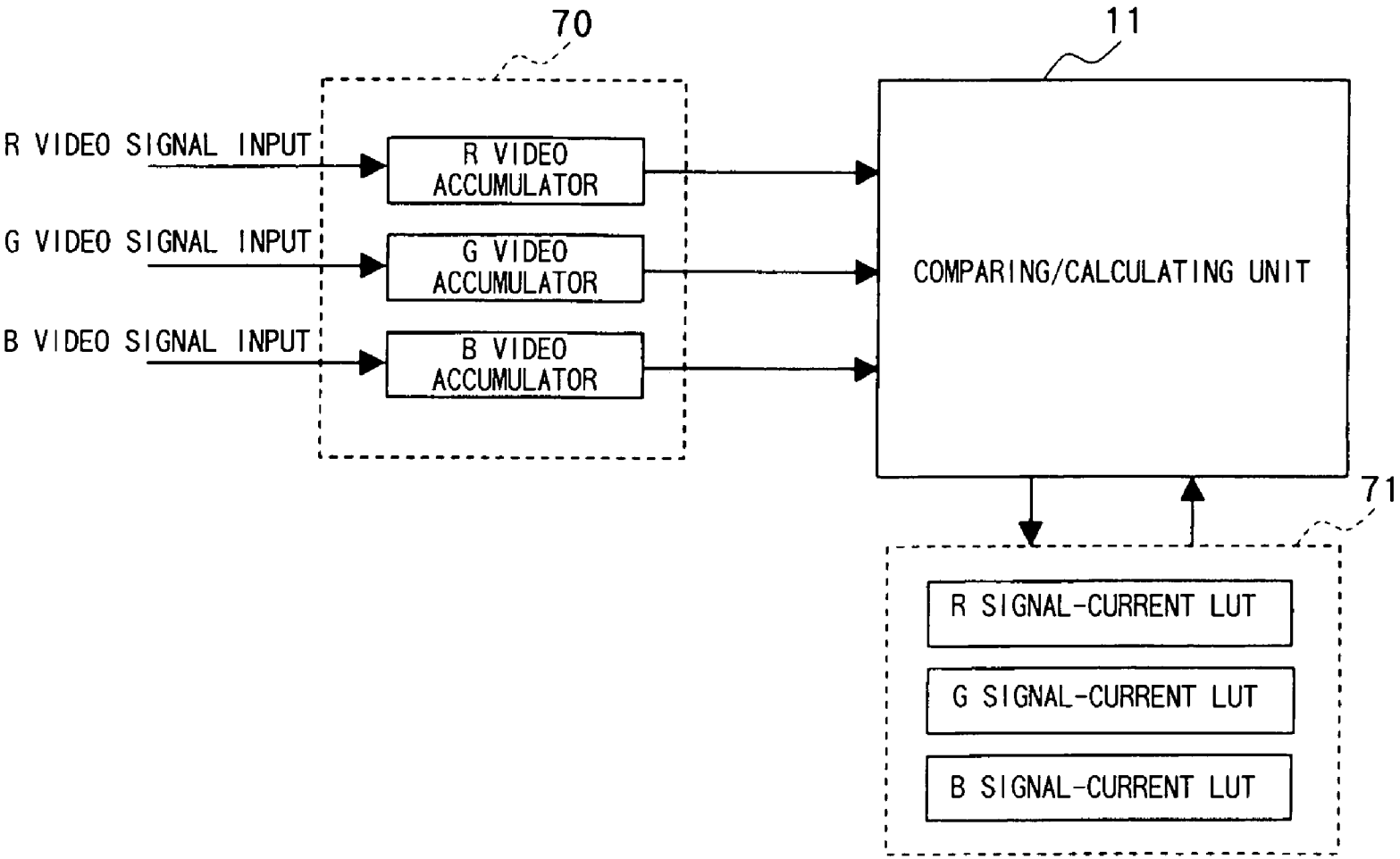
FIG. 14 is a block diagram showing the construction wherein the video signal accumulators and the lookup tables are connected to the comparing/calculating unit.
Figure 15:
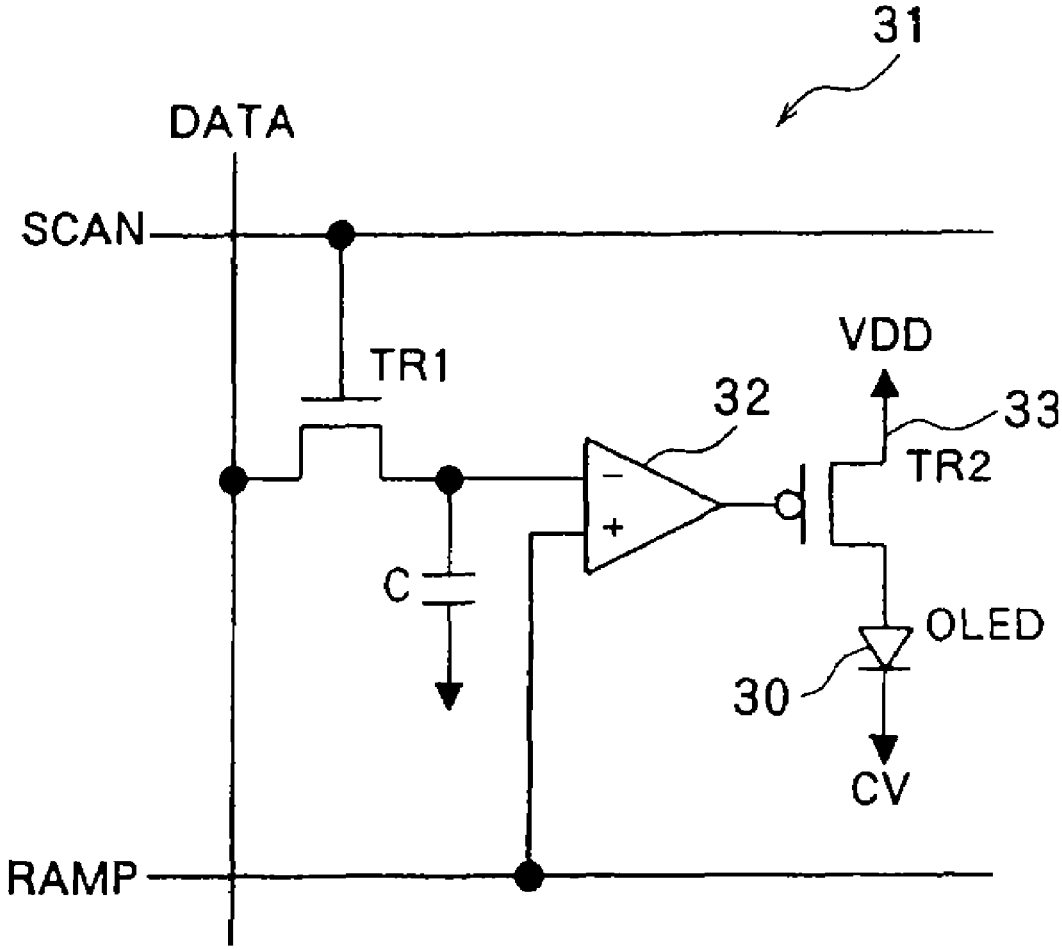
FIG. 15 PRIOR ART
FIG. 15 is a diagram showing the circuit construction of the pixel with the organic LED display device proposed by the present applicants.
Figure 16:
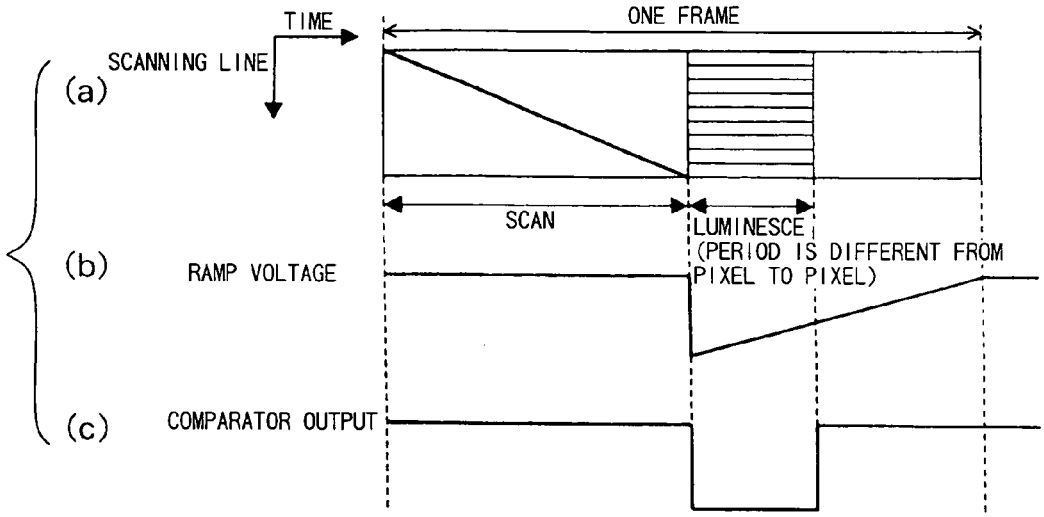
FIG. 16 is a waveform diagram showing an operation of the circuit construction.
Figure 17:
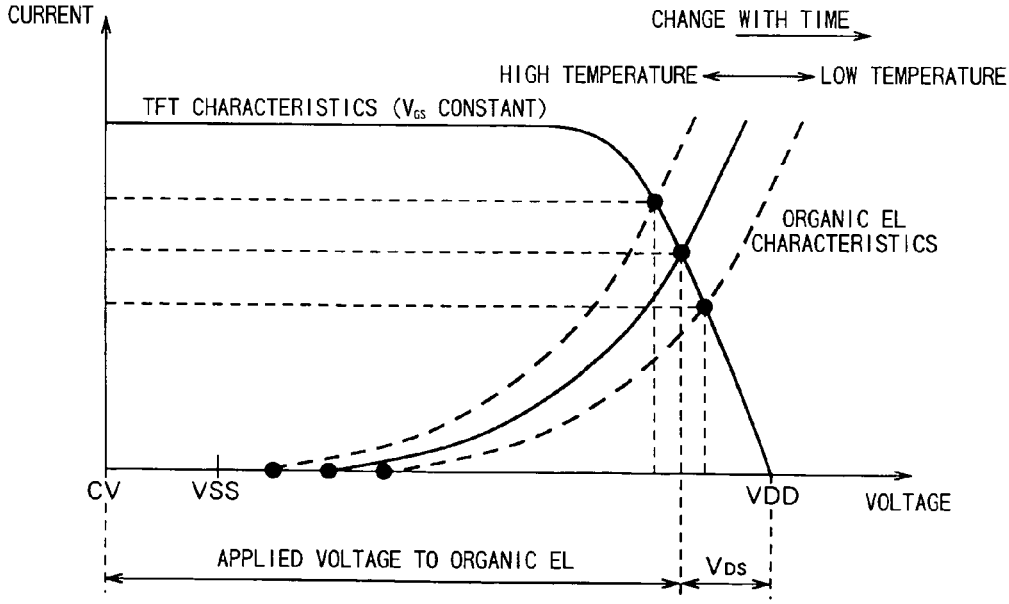
FIG. 17 is a graph showing transistor characteristics and organic EL characteristics.

According to the embodiment described, as shown in FIG. 9, the lookup table 7 is connected to the video signal accumulator 60, which converts the accumulated value of the video data into the sum of currents. It is possible to use another arrangement wherein the lookup table 71 is connected to the comparing/calculating unit 11, which refers to the lookup table 71 to thereby convert the accumulated value obtained from the video signal accumulator 70 into the sum of currents, as shown in FIG. 14.

Further according to the embodiment described, the present invention is embodied into the organic LED display device for feeding the data voltage from the drive IC 20 to the organic LED display 3. However, the invention can also be embodied into the organic LED display device for feeding the data current thereof. In this case, in the drive IC 20, the relationship between the video data and the data current is changed depending on the change with temperature and time of the organic EL element.

Still furthermore, according to the above embodiment, when, for example, a control signal for the pixels of R is to be prepared, video image is displayed on the organic LED display 3 only with the pixels of R to calculate the sum A of currents to have been passed through each pixel of R and to derive the sum B of currents to be passed through each pixel of R based on the accumulated value of the video data. It is also possible to obtain these values A, B with a method to be described below. That is, when the video image is displayed on the organic LED display 3 with the RGB pixels, the sum $A_0$ of currents to have been passed through each pixel of RGB is calculated, and the sum $B_0$ of currents to be passed through each pixel of RGB is derived based on the accumulated value of the video data. Thereafter, the video data for the pixels of R is changed to the value of zero to thereby display the video image with the pixels of G and B, to calculate the sum $A_1$ of currents to have been passed through each pixel of G and B, and to derive the sum $B_1$ of currents to be passed through each pixel of G and B based on the accumulated value of the video data. Thereafter the sum $A_1$ of currents to have been passed through each pixel of G and B is subtracted from the sum $A_0$ of currents to have been passed through each pixel of RGB. Thus obtained is the sum A ($A=A_0-A_1$) of currents to have been passed through each pixel of R when the video image is displayed with the RGB pixels. Furthermore, the sum $B_1$ of currents to be passed through each pixel of G and B is subtracted from the sum $B_0$ of the currents to be passed through each pixel of RGB. Thus obtained is the sum B ($B=B_0-B_1$) of currents to be passed through each pixel of R when the video image is displayed with the RGB pixels. According to the specific construction described, for example, in the preparation of the control signal for the pixels of R, the video data for the pixels of R is changed to the value of zero, but it is also possible to use the arrangement wherein the video data is changed to a given predetermined value.

Furthermore, according to the First and Second embodiments, the present invention is embodied into the organic LED display device, but can be embodied into known various display devices which comprise a display element wherein the passage of current is changed due to the temperature change and the deterioration with time and which is adapted to measure a current to be passed through the display element.

What is claimed is:

1. A display device comprising a display panel having an arrangement of a plurality of pixels and a control unit for supplying data voltage or data current corresponding to a video signal fed from the outside to each pixel of the display panel, each pixel of the display panel comprising a display element operable to luminesce when supplied with current and drive means for supplying to the display element a drive current corresponding to the data voltage or the data current from the control unit, the control unit comprising:

deriving means for deriving the sum of currents to be passed through each pixel of the display panel based on values of the video signals for each pixel of the display panel, current measuring means for measuring the total quantity of currents to have been passed through the pixels of the display panel, and calculation processing means for correcting the video signals for each pixel of the display panel based on a derived value obtained by the deriving means and a measurement value obtained by the current measuring means, wherein the deriving means comprises accumulating means for accumulating the values of the video signals for each pixel of the display panel, and conversion means for converting an accumulated value obtained by the accumulating means into the sum of currents to be passed through each pixel of the display panel, the calculation processing means correcting the video signals based on the conversion value obtained by the conversion means and the measurement value obtained by the current measuring means.

2. A display device according to claim 1, wherein the calculation processing means comprises correction coefficient calculating means for calculating a correction coefficient based on the conversion value and the measurement value and correcting means for correcting the video signals with use of the calculated correction coefficient.

3. A display device according to claim 2, wherein the correcting means of the calculation processing means varies the calculated correction coefficient depending on a position of the pixel.

4. A display device according to claim 2, wherein a display area of the display panel can be divided into a plurality of areas, the correction coefficient being calculated for each of the areas, the plurality of areas being each set to a correction coefficient calculating area one after another, the control unit comprising video signal setting means for performing an operation for selling the values of the video signals for the pixels in areas except the correction coefficient calculating area to a predetermined value such that the magnitude of the drive current to be fed to the display elements of said pixels is zero, upon the video signal setting means, performing a setting operation, the accumulating means performing the accumulating operation and the current measuring means performing the measuring operation, the correction coefficient calculating means of the calculation processing means calculating the correction coefficient for each of the areas, the correcting means correcting the video signals for the pixels in each of the areas with use of the correction coefficient for each of the areas.

5. A display device according to claim 4, wherein the correction coefficient can be calculated for each color of the three primary colors, the three primary colors being each set to a correction coefficient calculating color one after another, the video signal setting means setting to said predetermined value the values of the video signals for the pixels of the two colors except the correction coefficient calculating color and among the pixels in the correction coefficient calculating area, the correction coefficient calculating means of the calculation processing means calculating the correction coefficient for each color, the correcting means correcting the video signals for each color pixel with use of the correction coefficient for each color.

6. A display device according to claim 5, wherein the control unit further comprises relationship means for defining for each color the relationships between the accumulated value of the video signals and the sum of currents, the conversion means converting the accumulated value of the video signals into the sum of currents according to the relationship for the correction coefficient calculating color and among the relationships defined in the relationship means.

7. A display device according to claim 4, wherein the video signal setting means performs the setting operation at a longer cycle than a frame cycle of the video signal.

8. A display device according to claim 2, wherein a display area of the display panel is divided into a plurality of areas, the correction coefficient being calculated for each of the areas, the plurality of areas being each set to the correction coefficient calculating area one after another, the control unit comprising video signal setting means for performing an operation for setting the values of the video signals for the pixels in the correction coefficient calculating area to a value such that the magnitude of the drive current to be fed to the display elements of said pixels is zero or a given predetermined value, upon the video signal setting means' performing a setting operation or ceasing a setting operation, the accumulating means performing the accumulation operation while the current measuring means performing the measurement operation, the calculation processing means further comprising:

first subtraction means for subtracting a conversion value obtained when the video signal setting means performs a setting operation from a conversion value obtained when the video signal setting means ceases a setting operation, and second subtraction means for subtracting a measurement value obtained when the video signal setting means performs a setting operation from a measurement value obtained when the video signal setting means ceases a setting operation, the correction coefficient calculating means calculating a correction coefficient for each of the areas based on the subtraction result obtained by the first subtraction means and the subtraction result obtained by the second subtraction means, the correcting means correcting the video signals for the pixels in each of the areas with use of the correction coefficient for each of the areas.

9. A display device according to claim 8, wherein the correction coefficient can be calculated for each color of the three primary colors, the three primary colors being each set to the correction coefficient calculating color one after another, the video signal setting means setting the values of the video signals for the pixels of the correction coefficient calculating color and among pixels in the correction coefficient calculating area to a value such that the magnitude of the drive current to be fed to the display element of said pixels is zero or a given predetermined value, the correction coefficient calculating means of the calculation processing means calculating a correction coefficient for each color, the correcting means correcting the video signals for each color pixel with use of the correction coefficient for each color.

10. A display device according to claim 9, wherein the control unit comprises relationship means for defining for each color the relationships between the accumulated value of the video signals and the sum of currents, the accumulating means accumulating, for each color, the values of the video signals, the conversion means converting, for each color, the accumulated value of the video signals into the sum of currents according to the relationships defined in the relationship means.

11. A display device according to claim 8, wherein the video signal setting means performs the setting operation at a longer cycle than a frame cycle of the video signal.

12. A display device comprising a display panel having an arrangement of a plurality of pixels and a control unit for supplying data voltage or data current corresponding to a video signal fed from the outside to each pixel of the display panel, each pixel of the display panel comprising a display element operable to luminesce when supplied with current and drive means for supplying to the display element drive current corresponding to the data voltage or the data current from the control unit, the control unit comprising:

deriving means for deriving the sum of currents to be passed through each pixel of the display panel based on values of the video signals for each pixel of the display panel, current measuring means for measuring the total quantity of currents to have been passed through pixels of the display panel, control means for preparing and outputting a control signal based on a derived value obtained by the deriving means and a measurement value obtained by the current measuring means, and data voltage/current supplying means for changing the relationship between the video signal and the data voltage or the data current according to the control signal output from the control unit, and supplying to each pixel of the display panel the data voltage or the data current corresponding to the video signal from the outside based on the changed relationship, wherein the deriving means comprises accumulating means for accumulating the values of the video signals for each pixel of the display panel, and conversion means for converting an accumulated value obtained by the accumulating means into the sum of currents to be passed through each pixel of the display panel, the control means preparing control signals based on the conversion value obtained by the conversion means and the measurement value obtained by the current measuring means.

13. A display device according to claim 12, wherein the relationship between the video signal and the data voltage or the data current is changeable for each color of the three primary colors, the three primary colors being each set to a relationship changing color one after another, the control means comprising video signal setting means for performing an operation for setting the values of the video signals for the pixels of the two colors except the relationship changing color to a predetermined value such that the magnitude of the drive current to be fed to the display elements of said pixels is zero, upon the video signal setting means' performing a setting operation, the accumulating means performing the accumulation operation while the current measuring means performing the measurement operation, the control means preparing control signals for each color, data voltage/current supplying means changing the relationship for each color according to the control signal for each color and supplying to each color pixel the data voltage or the data current corresponding to the video signal based on the changed relationship.

14. A display device according to claim 13, wherein the video signal setting means performs the setting operation at a longer cycle than a frame cycle of the video signal.

15. A display device according to claim 12, wherein the relationship between the video signal and the data voltage or the data current is changeable for each color of the three primary colors, the three primary colors being each set to a relationship changing color one after another, the control unit comprising video signal setting means for performing an operation for setting the values of the video signals for the pixels of the relationship changing color to a value such that the magnitude of the drive current to be fed to the display elements of said pixels is zero or a given predetermined value, upon the video signal setting means' performing a setting operation or ceasing a setting operation, the accumulating means performing the accumulation operation while the current measuring means performing the measurement operation, the control means comprises:

first subtraction means for subtracting a conversion value obtained when the video signal setting means performs a setting operation from a conversion value obtained when the video signal setting means ceases a setting operation, and second subtraction means for subtracting a measurement value obtained when the video signal setting means performs a setting operation from a measurement value obtained when the video signal setting means ceases a setting operation, the control means preparing a control signal for each color based on the subtraction result obtained by the first subtraction means and the subtraction result obtained by the second subtraction means, data voltage/current supplying means changing the relationship for each color according to the control signal for each color and supplying to each color pixel the data voltage or the data current corresponding to the video signal based on the changed relationship.

16. A display device according to claim 15, wherein the video signal setting means performs the setting operation at a longer cycle than a frame cycle of the video signal.

* * * * *